US009532638B2

(12) United States Patent
Davis

(10) Patent No.: US 9,532,638 B2
(45) Date of Patent: Jan. 3, 2017

(54) APPARATUS FOR RETAINING A PLURALITY OF HAIR CARE DEVICES

(71) Applicant: Michael L. Davis, Biloxi, MS (US)

(72) Inventor: Michael L. Davis, Biloxi, MS (US)

( * ) Notice: Subject to any disclaimer, the term of this patent is extended or adjusted under 35 U.S.C. 154(b) by 0 days.

(21) Appl. No.: 14/680,498

(22) Filed: Apr. 7, 2015

(65) Prior Publication Data

US 2015/0282596 A1 Oct. 8, 2015

Related U.S. Application Data

(60) Provisional application No. 61/976,561, filed on Apr. 8, 2014.

(51) Int. Cl.

*A47F 7/00* (2006.01)
*A45D 44/02* (2006.01)
*A45D 44/04* (2006.01)

(52) U.S. Cl.

CPC ..... *A45D 44/02* (2013.01); *A45D 44/04* (2013.01); *A47F 7/005* (2013.01); *A47F 7/0028* (2013.01)

(58) Field of Classification Search

CPC ..... A45D 44/00; A45D 44/02; A45D 44/04; A45D 27/22; A47F 2007/0085; A47F 7/005; A47F 7/0028; A47F 7/0035; A47B 2097/003; H01R 13/72; H02G 11/02

USPC .... 211/26.2, 10, 11; 191/12.2 R, 12 R, 12.4; 439/501; 242/400, 378.4, 371, 378; 206/351; 132/314

See application file for complete search history.

(56) References Cited

U.S. PATENT DOCUMENTS 2,979,576 A * 4/1961 Huber ..... H02G 11/02 191/12.4
3,821,496 A * 6/1974 Malone ..... A61B 5/04 191/12.2 R
4,068,760 A * 1/1978 Johnson, Jr. ..... A45D 44/00 206/38
4,114,736 A * 9/1978 Scherenberg ..... H02G 11/02 191/12.4
4,483,330 A * 11/1984 Jacobsen ..... A63B 21/015 242/378.4
4,979,524 A * 12/1990 Anderson ..... A45D 19/00 132/202
5,379,903 A * 1/1995 Smith ..... A45D 44/02 132/289
5,547,393 A * 8/1996 Jansen ..... A45D 20/12 132/233
5,701,981 A * 12/1997 Marshall ..... H02G 11/02 191/12.4

(Continued)

*Primary Examiner* — Jennifer E Novosad
(74) *Attorney, Agent, or Firm* — Dale J. Ream

(57) ABSTRACT

An apparatus for retaining hair care devices includes a framework having a base member, a plurality of cradle members supported atop the base member, and defining an interior area situated rearwardly of the plurality of cradle members. Each cradle member includes a bottom support wall and an upstanding back support wall extending upwardly from the bottom support wall that are, together, configured to support a respective hair care device in a generally reclined configuration. A plurality of spring-loaded reels is rotatably mounted in the interior area, each reel being positioned in association with an associated cradle member and configured to rotatably receive a respective power cord of a respective hair care device. Each bottom support wall of respective cradle members define an aperture through which a respective power cord is received into the interior area for attachment to a respective reel.

11 Claims, 5 Drawing Sheets

(56) References Cited

U.S. PATENT DOCUMENTS 5,794,799 A * 8/1998 Collins ..... A45D 1/20 211/60.1
5,913,487 A * 6/1999 Leatherman ..... H02G 11/02 191/12.2 R
5,917,694 A * 6/1999 Denny ..... A45D 1/00 206/372
6,095,156 A * 8/2000 Smith, II ..... A45D 44/02 132/286
6,305,388 B1 * 10/2001 Zeller ..... A45D 44/02 132/287
6,331,121 B1 * 12/2001 Raeford, Sr. ..... H01R 13/72 174/67
6,591,952 B1 * 7/2003 Randall ..... A45D 44/02 191/12.4
6,969,275 B1 * 11/2005 Brock ..... H01R 13/60 439/502
7,168,538 B2 * 1/2007 Pena ..... H02G 11/02 191/12.2 R
7,209,038 B1 * 4/2007 Deconinck ..... G08B 13/1409 340/541
7,513,361 B1 * 4/2009 Mills, Jr. ..... A45D 44/00 132/315
7,874,410 B2 * 1/2011 Fulbrook ..... A61M 5/1415 191/12 R
7,909,162 B1 * 3/2011 Barrett ..... A45C 11/00 132/286
8,360,373 B2 * 1/2013 Johnson ..... A47F 7/024 211/26
8,465,318 B2 * 6/2013 Kartes ..... H01R 13/465 439/501
8,522,969 B2 * 9/2013 Mason ..... A45D 44/06 206/234
8,544,623 B1 * 10/2013 Murphy ..... H02G 11/02 191/12.4
8,844,735 B1 * 9/2014 Selby ..... B65D 85/04 211/181.1
2006/0201895 A1 * 9/2006 Jackson ..... H01H 9/025 211/13.1
2014/0366390 A1 * 12/2014 Lampley ..... B65H 75/34 30/537
2015/0282596 A1 * 10/2015 Davis ..... A45D 44/04 242/371

* cited by examiner

APPARATUS FOR RETAINING A PLURALITY OF HAIR CARE DEVICES

CROSS REFERENCE TO RELATED APPLICATIONS

This non-provisional patent application claims the benefit of provisional application Ser. No. 61/976,561 filed on Apr. 8, 2014, titled Apparatus for Retaining a Plurality of Hair Care Devices.

BACKGROUND OF THE INVENTION

This invention relates generally to racks for retaining barbershop devices and, more particularly, to an apparatus for retaining a plurality of hair care accessories having a plurality of retractable reel assemblies configured to maintain power cords in an untangled manner.

A barber or salon technician uses many electric hair care devices throughout the course of a day and, sometimes, in the course of cutting or grooming a single client's hair. For instance, a barber may have five or six electric clippers each being configured to cut hair to a predetermined depth or having a predetermined blade width. A common problem is that the electric cords of these numerous electric devices become tangled with one another. Further, tangled electric cords may result in the cords wearing down and leaving exposed wires. The cords must either be repaired or completely replaced at considerable expense.

Various devices have been proposed in the prior art for minimizing or eliminating the problem of tangled electric cords. Namely, cords may be organized using strap ties. Alternatively, a thick plastic sleeve may be coupled to the electric cords to prevent the wear and tear suggested above. Although assumably effective for their intended purposes, the existing products and methods for alleviating the negative results of tangled electric cords in a barbershop or salon environment, electric cords still get tangled when hair care devices are repeatedly extended and then returned to a storage position amongst multiple other devices.

Therefore, it would be desirable to have an apparatus to retain a plurality of hair care devices in a manner that keeps respective power cords from tangling.

SUMMARY OF THE INVENTION

Accordingly, an apparatus for retaining hair care devices according to the present invention includes a framework having a base member, a plurality of cradle members supported atop the base member, and defining an interior area situated rearwardly of the plurality of cradle members. Each cradle member includes a bottom support wall and an upstanding back support wall extending upwardly from the bottom support wall that are, together, configured to support a respective hair care device in a generally reclined configuration. A plurality of spring-loaded reels is rotatably mounted in the interior area, each reel being positioned in association with an associated cradle member and configured to rotatably receive a respective power cord of a respective hair care device. Each bottom support wall of respective cradle members define an aperture through which a respective power cord is received into the interior area for attachment to a respective reel.

Therefore, a general object of this invention is to provide an apparatus for retaining a plurality of electrically operated hair care devices.

Another object of this invention is to provide a retaining apparatus, as aforesaid, having a plurality of retractable reel assemblies configured to rotatably receive and retain a power cord of a respective hair care device.

Still another object of this invention is to provide a retaining apparatus, as aforesaid, having a plurality of cradle members configured to support respective hair care devices.

Yet another object of this invention is to provide a retaining apparatus, as aforesaid, that is easy to use.

A further object of this invention is to provide a retaining apparatus, as aforesaid, that includes a USB port such that a cell phone or other portable electronic devices may be selectively recharged.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An apparatus for retaining a plurality of hair care devices according to a preferred embodiment of the present invention will now be described in detail with reference to FIGS. 1 to 5 of the accompanying drawings. The retaining apparatus 10 includes a framework 20 having a plurality of cradle members 30 and includes a plurality of reel assemblies 50 rotatably mounted in the framework 20.

Figure 2:
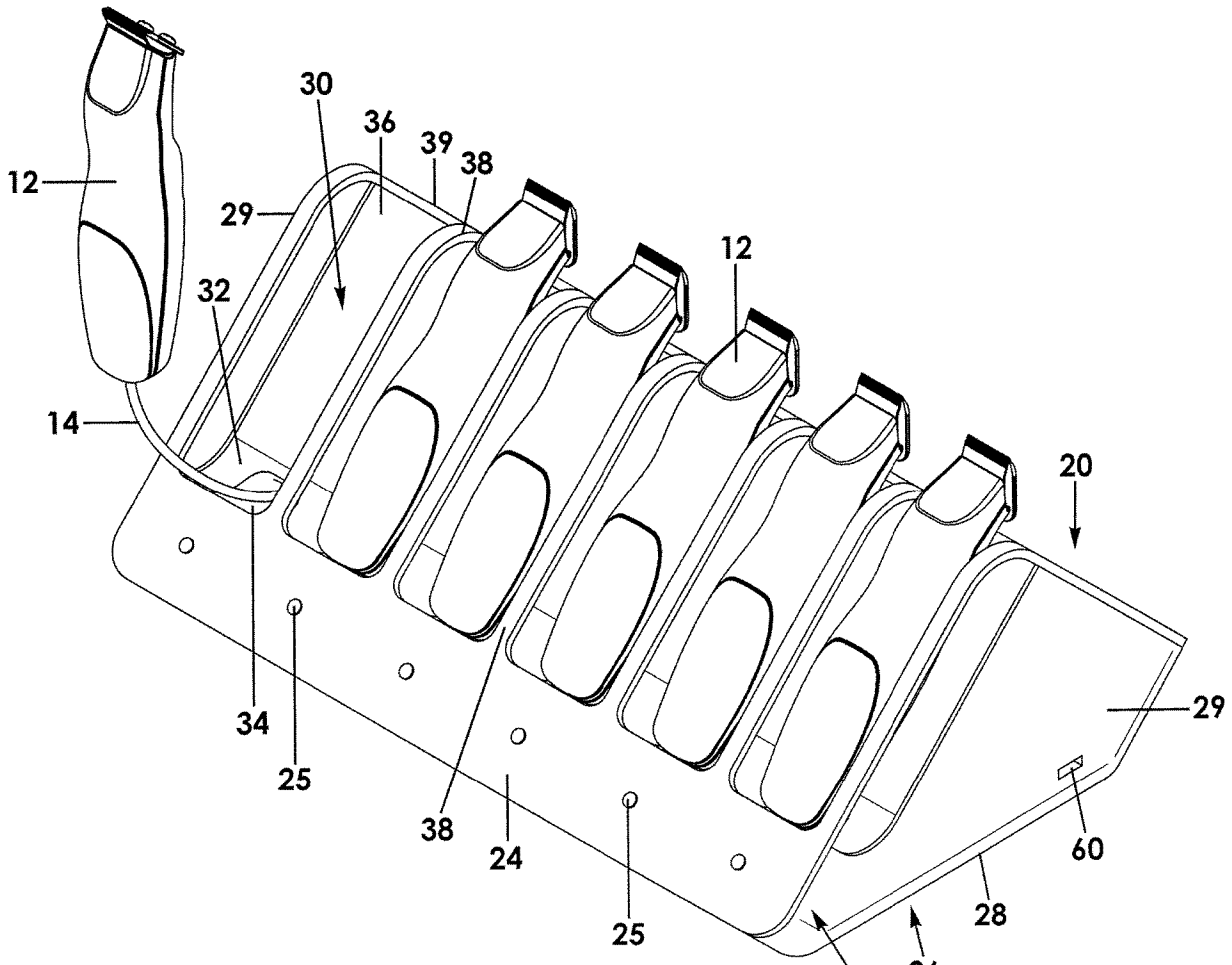
FIG. 2 is another perspective view of the retaining apparatus as in FIG. 1 with one hair care device extended from a respective cradle.
Figure 3:
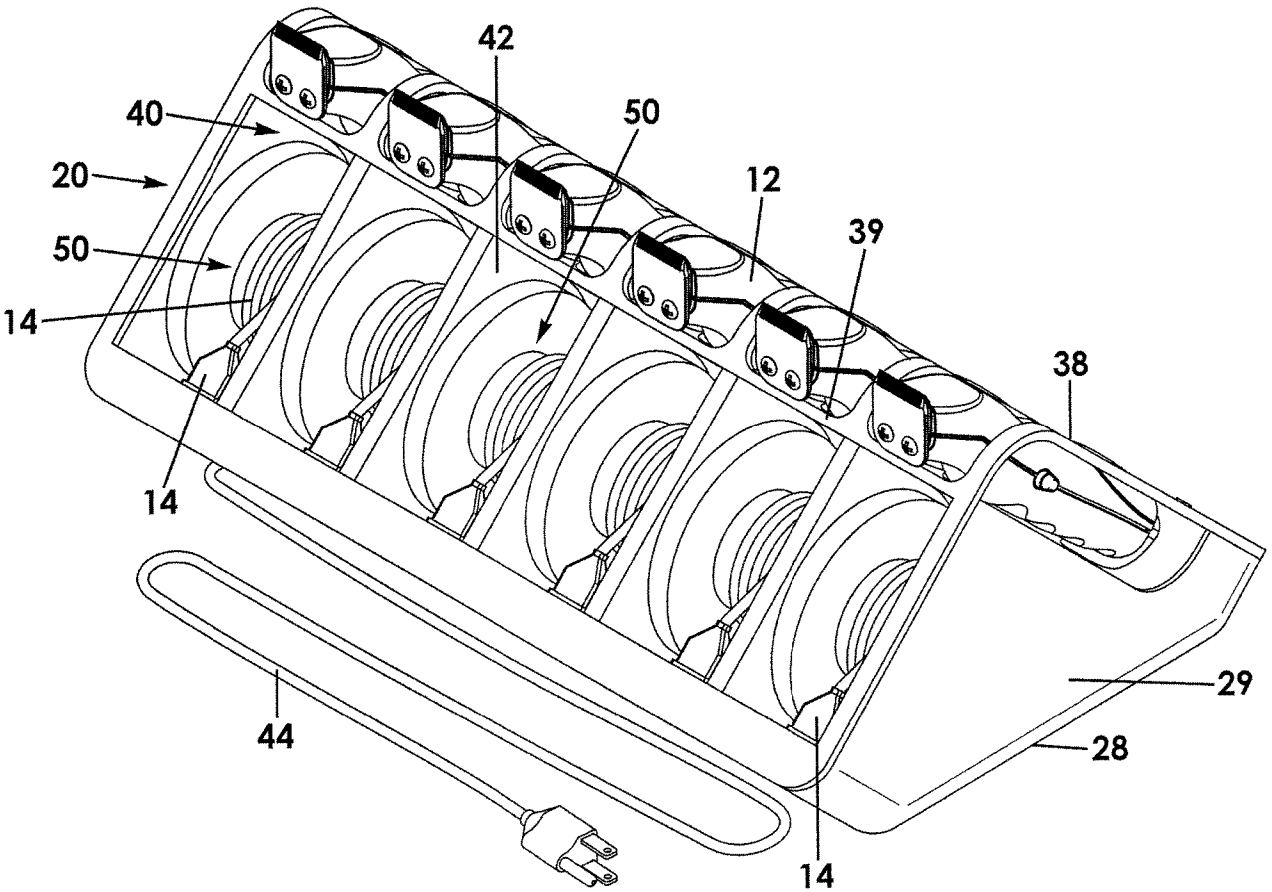
FIG. 3 is a rear perspective view of the retaining apparatus as in FIG. 1.

The framework 20 includes a base member 26 and a plurality of cradle members 30 mounted atop the base member 26. The base member 26 includes a bottom wall 28 and a pair of opposed side walls 29 extending upwardly from the bottom wall 28 (FIGS. 2 and 3). The framework 20 includes a front portion 22 having a plurality of cradle members 30. The cradle members 30 are positioned adjacent one another. More particularly, each cradle member 30 includes a bottom support wall 32 and an upstanding back support wall 36 extending upwardly from the bottom support wall 32. Together, associated bottom and back support walls are configured to support a respective hair care device 12 in a generally vertical and reclined configuration. Preferably, the cradle members 30 are configured to retain a plurality of electric hair clippers although it is understood that they may also retain a plurality of curling irons or other hair care devices.

Figure 4:
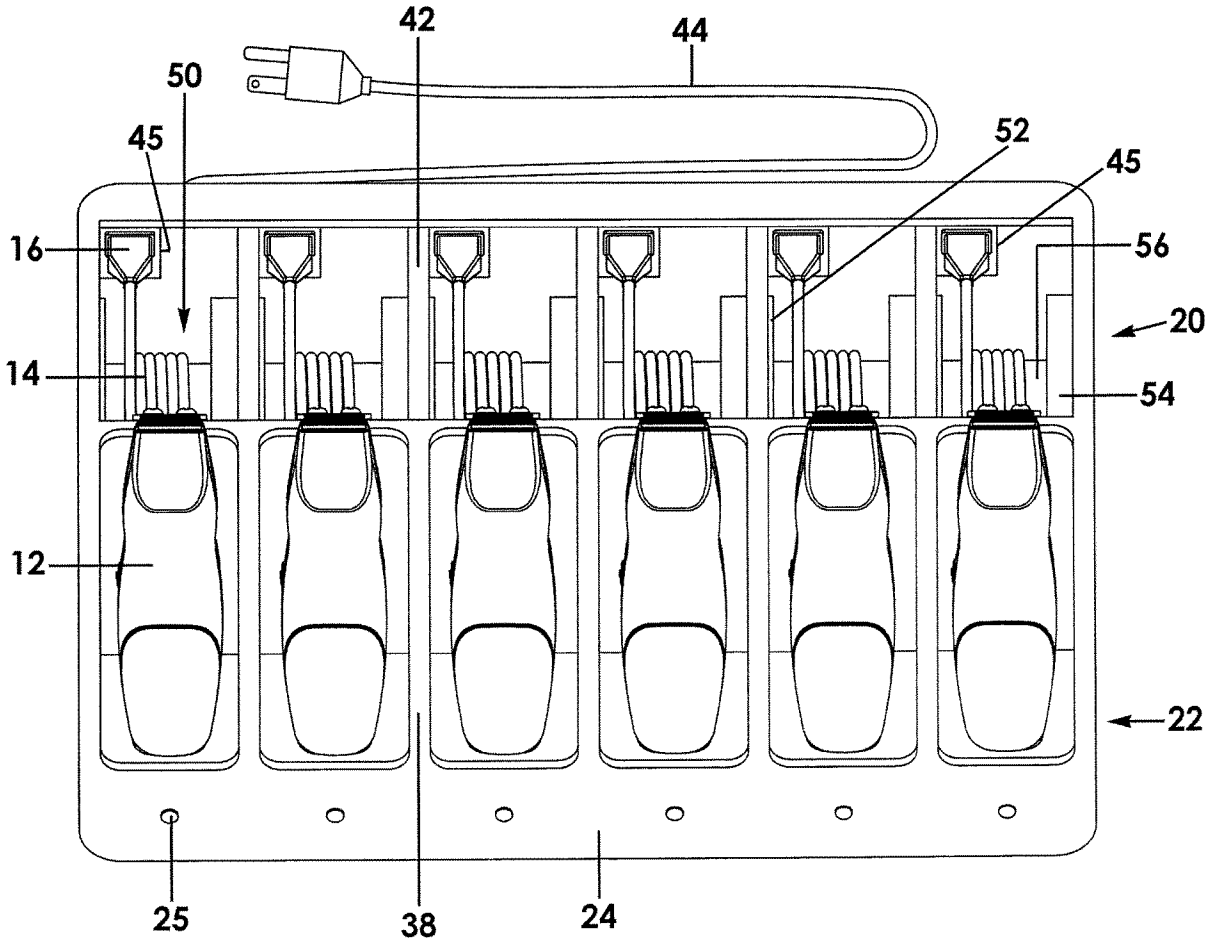
FIG. 4 is a top view of the retaining apparatus as in FIG. 1.
Figure 5:
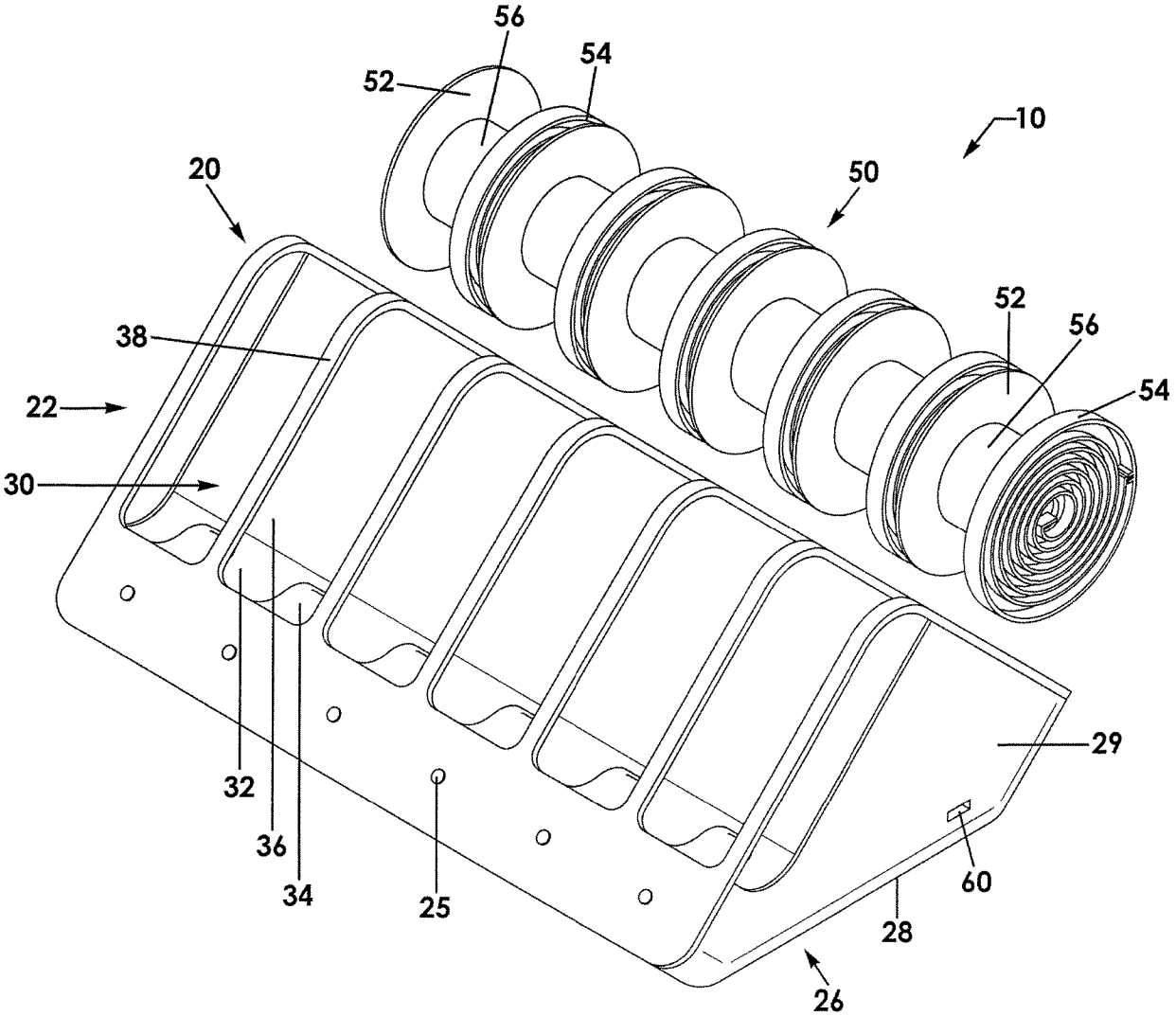
FIG. 5 is an exploded view of the retaining apparatus as in FIG. 1, with the hair care devices removed.

Together, the bottom wall 28, upstanding side walls 29, and plurality of cradle members 30 define an open interior area 40, the interior area 40 being positioned rearwardly of the cradle portions 30. A plurality of spaced apart upstanding intermediate walls 42 is situated in the interior area (FIG. 3). Each reel assembly 50 is rotatably mounted to respective adjacent intermediate walls 42 for operation as described below. As best shown in FIGS. 3 and 4, the open interior area 40 remains open to access from the top. This is important so that a user can position a power cord on a respective reel assembly 50 and plug in its power cord to an electrical receptacle as will be described later.

The front portion 22 of the framework 20 includes a front panel 24 extending between the side walls 29 adjacent to the bottom wall 28. The framework 20 also includes a plurality of partitions 38, a respective partition 38 extending upwardly from the front panel 24 to an upper support member 39 that extends between the side walls 29 adjacent an upper edge of respective back support walls 36.

Each respective bottom support wall 32 defines an aperture 34 in communication with the interior area 40 of the framework 20. Each aperture 34 is configured to receive a power cord 14 of a respective hair care device 12, for instance, a power cord 14 of an electric clipper device 12 (FIG. 2). The power cord 14 of a hair care device 12 is then received onto a respective reel assembly 50 as will be described further later.

Each reel assembly 50 includes a circular end wall 52, a coil spring 54, and a spool 56 extending between the end wall 52 and spring 54. Each reel assembly 50 is rotatably mounted in the interior space. Each spool 56 is configured to receive a power cord 14 such that the power cord 14 is wrapped thereabout as the reel assembly 50 is rotated. In use, a power cord 14 is inserted through a respective aperture 34 in a respective bottom support wall 32 of a respective cradle member 30 and wrapped about a respective spool 56 of a respective reel assembly 50.

A respective reel assembly 50 is rotatably movable between an extended configuration when a respective cord 14 is pulled away from a respective cradle (for instance, when a respective hair care device 12 is in use (FIG. 2)) and a retracted configuration when a respective cord is wrapped about a respective spool 56 (for instance, when a respective hair care device 12 is at rest in a respective cradle member 30 (FIG. 1)). The coiled spring 54 of a reel assembly 50 is configured to naturally bias the reel assembly 50 toward the retracted direction such that a respective power cord 14 is automatically retracted when a pulling or extending force is released.

The base member 26 of said framework 20 includes a plurality of power receptacles 45 positioned in the interior area (FIG. 3). The power receptacles 45 are spaced apart between the side walls 29 such that one receptacle 45 is associated with a respective reel assembly 50. Specifically, a respective plug 16 at the end of a respective power cord 14 may be electrically connected to a respective receptacle 45 such that electrical current is supplied to the respective power cord 14 of a respective hair care device 12. In addition, the framework 20 may include a power cable 44 in electrical communication with the plurality of power receptacles 45 so as to supply the receptacles with electrical power, such as from a wall outlet, battery, or other electrical source.

The retaining apparatus 10 includes a plurality of electrical status indicators 25 that indicate if electrical power is being received by a respective hair care device 12. More particularly, each electrical status indicator 25 may be a light emitting diode ("LED") that is in electrical communication with a respective electrical receptacle 45. The electrical connection therebetween may be configured such that the respective indicator 25 may receive electrical current and be illuminated with a respective power cord 14 of a respective hair care device 12 is plugged into a respective receptacle 45. The plurality of status indicators 25 may be positioned on the front panel 24 of the framework 20 (FIG. 1).

Figure 1:
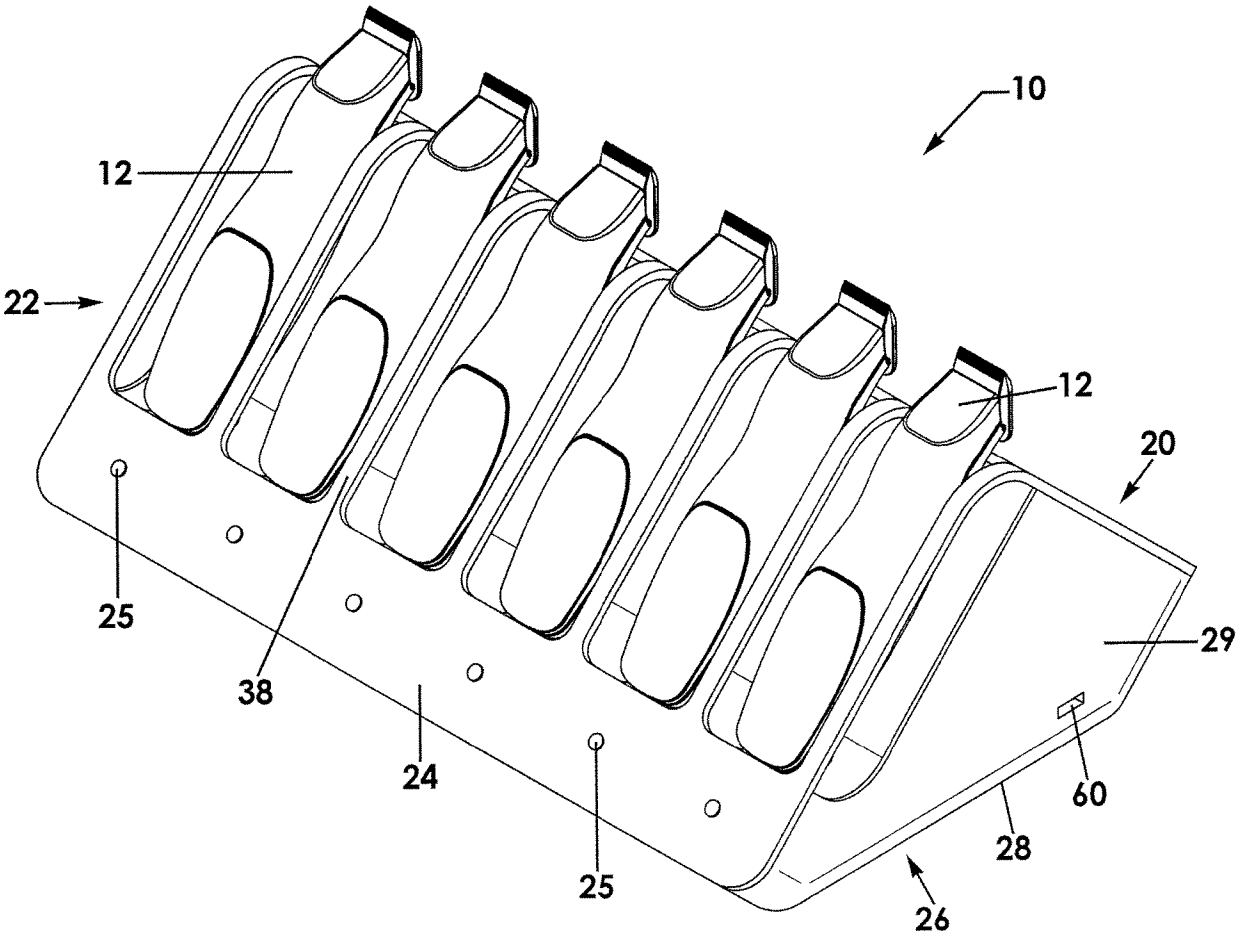
FIG. 1 is a perspective view of an apparatus for retaining a plurality of hair care devices according to a preferred embodiment of the present invention.

In one embodiment, the apparatus 10 may also include a universal serial bus ("USB") port 100 situated in the base member 26, either adjacent the front panel 24 or a side wall 29 (FIG. 1). The USB port 60, in turn, may be electrically connected to a nearest electrical receptacle 45 or the power cable 44 itself. In this embodiment, therefore, a user may plug a cellular phone or other rechargeable electronic device (not shown) into the retaining apparatus 10 and charged.

In use, a user of the apparatus 10 for retaining a plurality of hair care devices 12—such as a barber—may easily position multiple hair care devices 12 upon the apparatus 10. For instance, a barber may position multiple hair clippers (different sizes or styles) on respective cradle members 30. In each case, a respective power cord 14 may be inserted through a respective aperture 34 of a respective bottom support wall 32 and the wrapped around a respective spool 56 of a reel assembly 50. A respective plug 16 may be connected to a respective receptacle 45. When needed, the barber may remove a desired electrical clipper device 12 and extend it away from the retainer apparatus 10 which causes a respective reel assembly 50 to move in the extended configuration direction. When finished, the reel assembly automatically retracts as described above.

It is understood that while certain forms of this invention have been illustrated and described, it is not limited thereto except insofar as such limitations are included in the following claims and allowable functional equivalents thereof.

The invention claimed is:

1. An apparatus for retaining a plurality of hair care devices each having a power cord, comprising:

a framework that includes a base member, a plurality of cradle members supported atop said base member, and defining an interior area situated rearwardly of said plurality of cradle members;

wherein each cradle member includes a bottom support wall and an upstanding back support wall extending upwardly from said bottom support wall that are, together, configured to support a respective hair care device in a generally reclined configuration; and a plurality of reel assemblies rotatably mounted in said interior area of said framework, each reel assembly being positioned in association with an associated cradle member and configured to rotatably receive a respective power cord of a respective hair care device;

wherein:

said base member includes a front portion having a bottom wall and a pair of opposed side walls extending from said bottom wall and said side walls; and said framework includes a plurality of partitions, each partition extending upwardly from said front portion to an upper support panel.

2. The retaining apparatus as in claim 1, wherein each bottom support wall of a respective cradle member defines an aperture configured to receive a respective power cord of a respective hair care device therethrough.

3. The retaining apparatus as in claim 1, wherein each reel assembly is spring-loaded and normally biased to accumulate a respective power cord thereabout.

4. The retaining apparatus as in claim 1, wherein said base member includes a plurality of spaced apart power receptacles positioned in said interior area, each power receptacle being associated with a respective reel assembly such that a respective plug of a respective hair care device is adapted to be selectively electrically connected to a respective power receptacle.

5. The retaining apparatus as in claim 4, wherein said framework includes a power cable in electrical communication with said plurality of said power receptacles such that electrical current is supplied to said plurality of power receptacles when said power cable is connected to an electrical power source.

6. The retaining apparatus as in claim 5, further comprising a universal serial bus ("USB") port electrically connected to said power cable.

7. The retaining apparatus as in claim 4, wherein each reel assembly includes:

a circular end wall;

a spring;

a spool operatively coupled to and extending between said end wall and said spring, each spool being configured to receive a power cord such that the power cord is adapted to be wrapped around said spool when each said reel is rotated.

8. The retaining apparatus as in claim 7, wherein each reel is selectively rotatably movable between a retracted configuration at which a respective power cord is adapted to be wrapped about a respective spool and an extended configuration at which said respective power cord is adapted to be extended away from a respective spool.

9. The retaining apparatus as in claim 8, wherein each said reel is automatically biased toward said retracted configuration.

10. The retaining apparatus as in claim 1, comprising a plurality of electrical indicators situated on said framework, each electrical indicator indicating that electricity is received by respective hair care devices.

11. The retaining apparatus as in claim 10, wherein each electrical indicator is a light emitting diode.

* * * * *